US008573453B2

(12) United States Patent
Jain

(10) Patent No.: US 8,573,453 B2
(45) Date of Patent: Nov. 5, 2013

(54) PLEAT MAKING DEVICE AND METHODS THEREOF

(76) Inventor: Suniti Jain, Fremont, CA (US)

( * ) Notice: Subject to any disclaimer, the term of this patent is extended or adjusted under 35 U.S.C. 154(b) by 281 days.

(21) Appl. No.: 12/906,093

(22) Filed: Oct. 16, 2010

(65) Prior Publication Data

US 2011/0259925 A1 Oct. 27, 2011

Related U.S. Application Data

(60) Provisional application No. 61/252,702, filed on Oct. 18, 2009.

(51) Int. Cl.
*A41H 43/00* (2006.01)
*D06J 1/12* (2006.01)

(52) U.S. Cl.
USPC ..... 223/34; 223/35

(58) Field of Classification Search
USPC ..... 223/28–38; 16/348–350
See application file for complete search history.

(56) References Cited

U.S. PATENT DOCUMENTS

| | | | | | |
|---|---|---|---|---|---|
| 3,570,580 | A * | 3/1971 | Warner | 160/348 |
| 3,695,489 | A * | 10/1972 | Kirche | 223/34 |
| 3,726,449 | A * | 4/1973 | Kern | 223/35 |
| 3,974,946 | A * | 8/1976 | Gentry | 223/34 |
| 3,984,048 | A * | 10/1976 | Rethemeyer et al. | 223/35 |
| 4,157,775 | A * | 6/1979 | Soto | 223/34 |
| 4,903,370 | A * | 2/1990 | Erdmann | 16/87.2 |
| 5,137,190 | A * | 8/1992 | Plaud | 223/33 |
| 5,501,378 | A * | 3/1996 | Kolton et al. | 223/87 |
| 8,002,156 | B2 * | 8/2011 | Ota | 223/35 |
| 2009/0044920 | A1 * | 2/2009 | De Angelis | 160/349.2 |

* cited by examiner

*Primary Examiner* — Ismael Izaguirre
(74) *Attorney, Agent, or Firm* — The Law Offices of Eric W. Peterson

(57) ABSTRACT

The present disclosure pertains to a pleat making device used to create pleats of fabric while the pleat making device is mounted to clothing. The pleat making device can have a frame for supporting the fabric, a fabric securing member for securing the fabric to the frame, and a segment frame hinge that allows for the rotation of a plurality of segment frames around an axis.

21 Claims, 9 Drawing Sheets

PLEAT MAKING DEVICE AND METHODS THEREOF

CROSS-REFERENCE TO RELATED APPLICATION

This application claims the benefit of priority to U.S. Provisional Application No. 61/252,702, filed on Oct. 18, 2009, which is incorporated herein by reference in its entirety.

BACKGROUND

A "sari" is a type of dress or ensemble widely used by women from India. Saris typically constitute a six yard long piece of thin fabric that is first wound around the waist over a petticoat and the remainder slung over the shoulder or arm. It is worn by Indian girls and women, residing in India or abroad either daily or on special occasions. A sari is also occasionally worn by people of non-Indian origin.

A recurring part of the sari donning process is the making of pleats each time using a portion of the fabric worn around the waist. At present, ladies make pleats by maneuvering the fabric with their fingers using both hands. Often women of younger generations require assistance from another person in making these pleats. Manual making of the pleats is inconvenient, tiring to the hands, and does not always result in same width of each pleat. Even the practiced sari wearer has to add in the time to carefully make the large, equally sized pleats. Many people simply don't know how to make these pleats and are dependent on help or choose not to wear a sari.

SUMMARY OF THE INVENTION

The present disclosure pertains to a pleat making device. In one embodiment, the pleat making device has a frame and a fabric securing member, where the fabric securing member engages the frame. In one embodiment, the frame comprises a segment frame. In one embodiment, the frame also has a segment frame hinge that engages a first segment frame and engages a second segment frame allowing the segment frames to rotate between a first position and a second position. In one embodiment, the frame also has a segment frame hinge where the segment frame hinge engages a plurality of segment frames and allows the segment frames to move between a first position and a second position around a common axis. In one embodiment, the segment frame hinge allows the segment frames to move horizontally, thereby staggering each segment frame in relation to the other segment frames. In one embodiment, the frame also has a segment frame holder where the segment frame holder engages the segment frames and allows the segment frames to rotate in a manner where each segment frame rotates around a side common to each segment frame. In one embodiment, the frame also has a segment frame holder comprising a plurality of tracks, where a plurality of segment frames traverse the plurality of tracks. In one embodiment, the segment frame is at least two posts. In one embodiment, the fabric securing member is incorporated into the segment frame. In one embodiment, the frame also has a post hinge that allows for the movement of the at least two posts between a first position and a second position. In one embodiment, the frame also has a segment frame holder where the segment frame holder engages a plurality of segment frames and allows the segment frames to move between a first position and a second position. In one embodiment, the segment frame holder allows the segment frames in the first position to traverse through the segment frame holder to the second position. In one embodiment, the segment frame has a width adjusting member. In one embodiment, the segment frame has a feathered side that allows for the separation of the segment frames.

In one embodiment, the frame has a first frame member, a second frame member, a plurality of first posts, a plurality of second posts, and a handle having a first handle member and a second handle member, where the first posts engage the first frame member, the second posts engage the second frame member, the first handle member engages the first frame member, the second handle member engages the second frame member, and the fabric securing member is incorporated into the first frame member and the second frame member. In one embodiment, the first posts has a bottom vertical member, a horizontal member having a first end and a second end, and a top vertical member, where the bottom vertical member engages the first end of the horizontal member thereby creating a first substantially right angle, and the top vertical member engages the second end of the horizontal member thereby creating a second substantially right angle. In one embodiment, the pleat making device has a mounting member that allows the device to be mounted to clothing. In one embodiment, the pleat making device also has a means for collapsing the device that allows the device to be folded in a compact manner. In one embodiment, the pleat making device has a pleat gatherer that prevents the pleats from unraveling.

In one embodiment, the pleat making device is used by securing the fabric to a first segment frame by way of a fabric securing member, wrapping the fabric around the first segment frame, securing the fabric to the first segment frame by way of a fabric securing member, rotating the first segment frame away from a plurality of segment frames, securing the fabric to a different segment frame by way of a fabric securing member, wrapping the fabric around the different segment frame, securing the fabric to the different segment frame by way of a fabric securing member, rotating the different segment frame away from the plurality of segment frames, the aforementioned steps until the preferred number of segment frames are wrapped with fabric, gathering the pleats together utilizing a pleat gatherer, and removing the fabric from the pleat making device while maintaining the pleated form of the fabric.

BRIEF DESCRIPTION OF THE DRAWINGS

The accompanying drawings, which are incorporated herein and form part of the specification, illustrate various embodiments of the present invention and together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
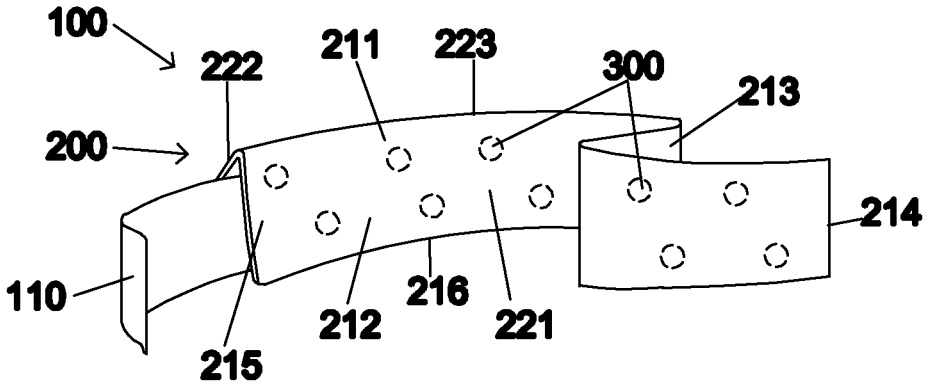
FIG. 1 is an elevated view the pleat making device according to an exemplary embodiment of the present invention.

In the following detailed description, reference is made to the accompanying drawings which form a part hereof and in which is shown by way of illustration specific embodiments in which the invention may be practiced. These embodiments are described in sufficient detail to enable those skilled in the art to practice the invention, and it is to be understood that other embodiments may be utilized and that structural or logical changes may be made without departing from the scope of the present invention. The following detailed description is, therefore, not to be taken in a limiting sense, and the scope of the present invention is defined by the appended claims.

The present disclosure pertains to a pleat making device 100 used to create pleats of fabric 110. In one aspect, the pleat making device 100 can be used to create pleats while mounted on clothing. The pleat making device 100 can be used to create stacked pleats or staggered pleats. The pleat making device 100 can have a frame 200 and a fabric securing member 300. The frame 200 provides support to the fabric 110 and pleats. The frame 200 can have top 211, side 212, side 213, side 214, side 215, and base 216. The frame 200 can be any configuration, shape, or size that allows for or supports the creation of pleats using fabric 110.

The fabric securing member 300 can engage the frame 200 and secures the fabric 110 to the frame 200. The pleat making device 100 can have any number of fabric securing members 300. The fabric securing member 300 can be embedded into the frame 200, incorporated into the frame 200, or engaged with the frame 200 on the surface of a side. The distance between the fabric securing members 300 can be substantially equal thereby allowing for the creation of stacked pleats or pleats that have substantially equal widths. In one aspect, the distance between the fabric securing members 300 can vary thereby allowing for the creation of pleats with varying widths. The fabric securing member 300 can be any means that allows fabric 110 to be secured to a frame 200, for example, without limitation, a clip, a pin, a clothes pin, a magnet, an alligator clip, a clamp, or the like. The fabric securing member 300 can also be a surface that creates friction and can be positioned on a segment frame 400, plate 410, post 430, or the like. In one aspect, the friction surface is positioned on the end of the segment frame 400, thereby preventing the fabric 110 from falling off the segment frame 400.

In one aspect, the frame 200 can have first folding member 221, second folding member 222, and folding hinge 223. The folding hinge 223 can connect the first folded member 221 with the second folded member 222. The folding hinge 223 can be any connecting means that allows for the rotation of two segments around the horizontal axis of the folding hinge 223, for example, without limitation, a hinge, a living hinge, a swivel hinge, a spiral binding, a glued binding, or the like. As shown in FIG. 1, for example, without limitation, the fabric securing member 300 can be magnets and can be embedded in the first folding member 221 and the second folding member 222. The fabric 110 can be placed adjacent to the first folding member 221 and the second folding member 222 can be folded over the fabric 110. The magnets of the first folding member 221 interact with the magnets of the second folding member 222 thereby securing the fabric 110 between the first folding member 221 and the second folding member 222. The frame 200 can be folded to a desired length that corresponds to a desired pleat length. In one aspect, clips can be used in conjunction with or in lieu of magnets.

Figure 2:
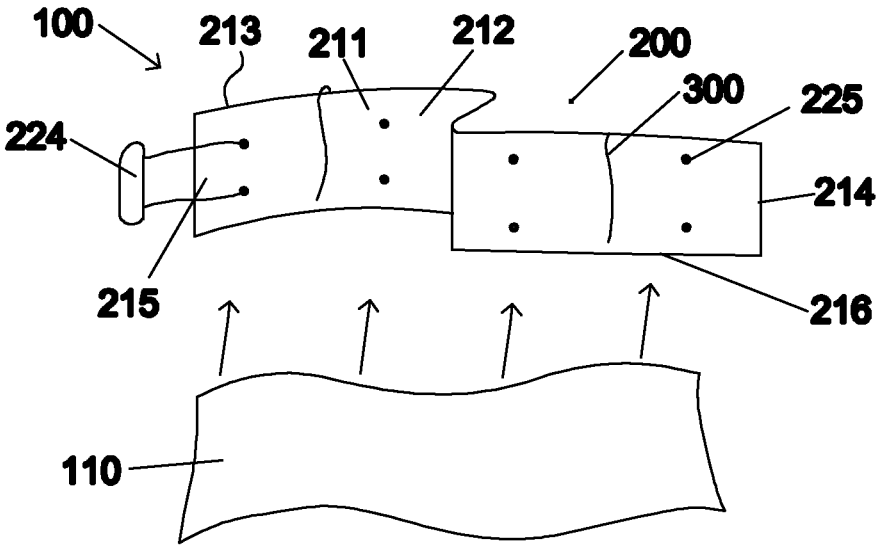
FIG. 2 is an elevated view the pleat making device according to an exemplary embodiment of the present invention.

In addition, the frame 200 can also have a frame folding member 224 and string holes 225. The frame folding member 224 can have two strings and a handle 280. As shown in FIG. 2, the strings can engage side 214 of the frame 200, pass through the string holes 225 in the frame 200, and engage the handle 280 on side 215 of the frame 200. The fabric 110 can be placed adjacent to the first folding member 221 and the second folding member 222 can be folded over the fabric 110. The fabric securing members 300 can be clips that are place over top the first folding member 221 and the second folding member 222, thereby pushing the first folding member 221 adjacent to the second folding member 222 and securing the fabric 110 between the two folding members. The handle of the frame folding member 224 is pulled to fold the frame 200 in an accordion style and thereby creating pleats in the fabric 110.

In one aspect, the frame 200 can have a plurality of segment frames 400 that provide support for the creation of a pleat and determine the width of a pleat. The segment frame 400 can be any shape and size that provides support for the creation of a pleat, for example, without limitation, a plate, a post, a clip, a pin, a clothes pin, a clamp, a rod, or the like. In one aspect, the fabric securing member 300 can engage the segment frame 400. In another aspect, the fabric securing member 300 can be incorporated into the segment frame 400. In another aspect, the device can have a combination of a fabric securing member 300 that can engage the segment frame 400 and a fabric securing member 300 that is incorporated into the segment frame 400.

Figure 3:
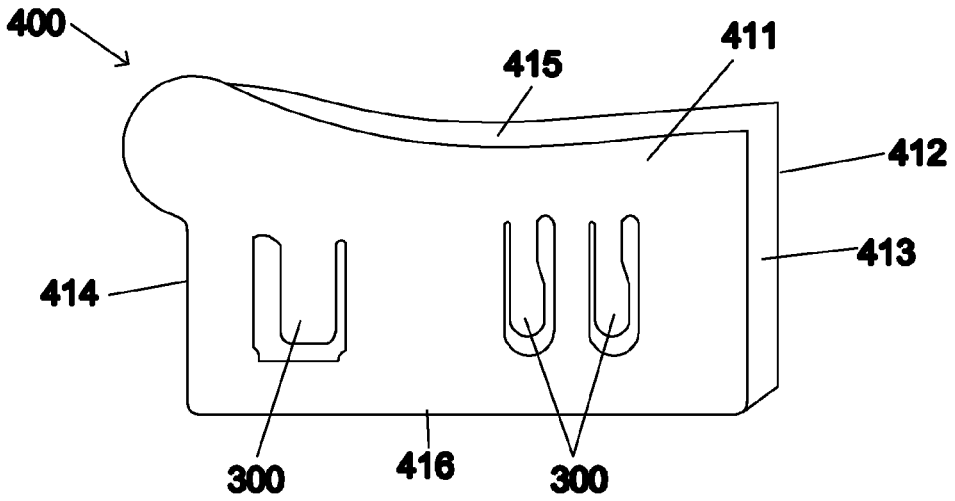
FIG. 3 is an elevated view the segment frame according to an exemplary embodiment of the present invention.

In one aspect, as shown in FIG. 3, for example, without limitation, the segment frames 400 can be a plate 410 where the fabric 110 is wrapped around the first plate 410 and around a second plate 410 thereby creating a pleat with a width that is substantially similar to the width of the plate 410. The segment frame 400 can have front surface 411, rear surface 412, side 413, side 414, top 415, and base 416. In this aspect, the plate 410 can have a fabric securing member 300 that is incorporated into the segment frame 400, a fabric securing member 300 that is engaged to the plate 410 in the form of a clip, pin, clothes pin, magnet, alligator clip, clamp, or the like, or a combination of fabric securing members 300 that are incorporated into the plate 410 or are engaged with the plate 410. When the fabric securing member 300 is incorporated into a plate 410, the fabric 110 can wrap around the plate 410, and the tension of the fabric 110 secures the fabric 110 to the plates 410.

In one aspect, the segment frame 400 can also have a feathered or tapered side that allows for the separation of the segment frames 400 with one hand or finger. In the preferred aspect, the top 415 is feathered.

In one aspect, the segment frame 400 can be at least two posts 430. The fabric 110 can be wrapped around the at least two posts 430 thereby creating a pleat with a width that is substantially similar to the distance between the two posts 430. In this example, the fabric securing member 300 can be incorporated into the segment frame 400 whereby when the fabric 110 is wrapped around a plurality of posts 430, the tension of the fabric 110 secures the fabric 110 to the posts 430.

In one aspect, the segment frame 400 can also have a width adjusting member 440 that can alter the width of the segment frame 400 depending on the desired length of a pleat. In one aspect, a width adjusting member 440 can engage the segment frame 400 where the width adjusting member 440 has at least one guide and at least one track, and the segment frame 400 has a first segment frame piece and a second segment frame piece, where the track engages the first segment frame piece, the guide engages the second segment frame piece, and the guide slidably engages the track. In said aspect, the guide travels the track thereby allowing the width of the segment frame 400 to increase or decrease depending on the desired width of a pleat.

Figure 4:
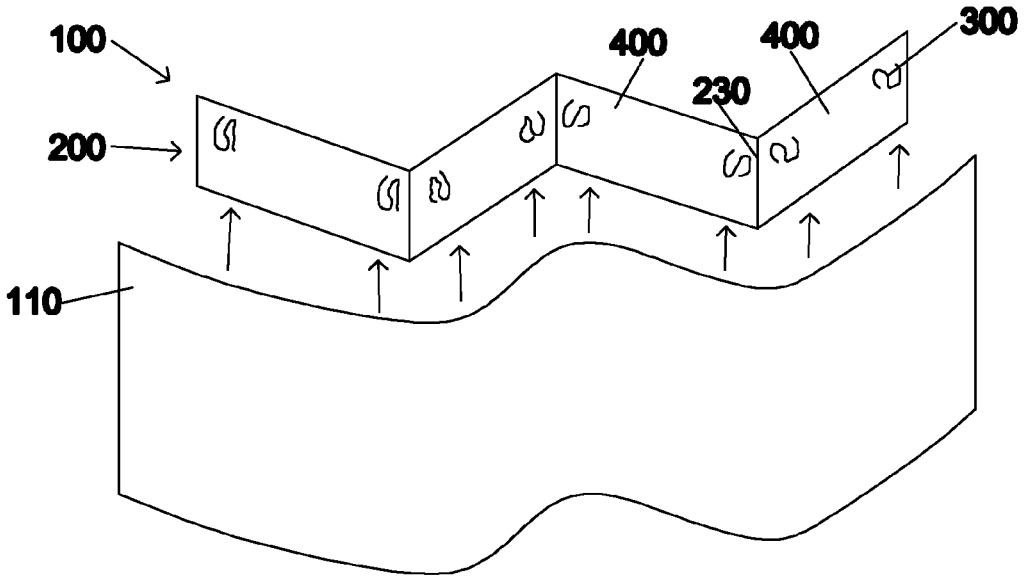
FIG. 4 is an elevated view the pleat making device according to an exemplary embodiment of the present invention.

In one aspect, the frame 200 can also have a segment frame hinge 230. The segment frame hinge 230 can engage a first segment frame 400 and can engage a second segment frame 400 thereby allowing said segment frames 400 to rotate between a first position and a second position. The segment frame hinge 230 can be any connecting device that allows for the rotation of two segment frames 400 around the axis of the segment frame hinge 230, for example, without limitation, a hinge, a living hinge, a swivel hinge, a spiral binding, a glued binding, or the like. As shown in FIG. 4, for example, without limitation, where the frame 200 has a plurality of segment frames 400, and the segment frames 400 are adjacent to each other and aligned in a linear manner, the segment frame hinge 230 can connect one segment frame 400 with another segment. In this aspect, the fabric securing members 300, here integral clips by way of example, engage the surface of the segment frame 400. The fabric 110 can be inserted into each integral clip thereby securing the fabric 110 to the frame 200. The pleat making device 100 can be folded in an accordion style thereby folding the secured fabric 110 in an accordion style and creating pleats.

In another example, without limitation, the width adjusting member 440 can have a cavity and a post where the cavity, lined with rivets and grooves, is incorporated into one segment frame 400, and a post, the top of which is lined with rivets and grooves, is received by a cavity of another segment. The rivets of the cavity are received by the rivets of the post. The post can be horizontally positioned in the cavity and the rivets lock the segment frames 400 in a horizontal direction. Also, the width adjusting member 440 can have a rotational member that allows for the segments to rotate around the vertical axis of the post and thereby fold in an accordion manner.

Figure 5:
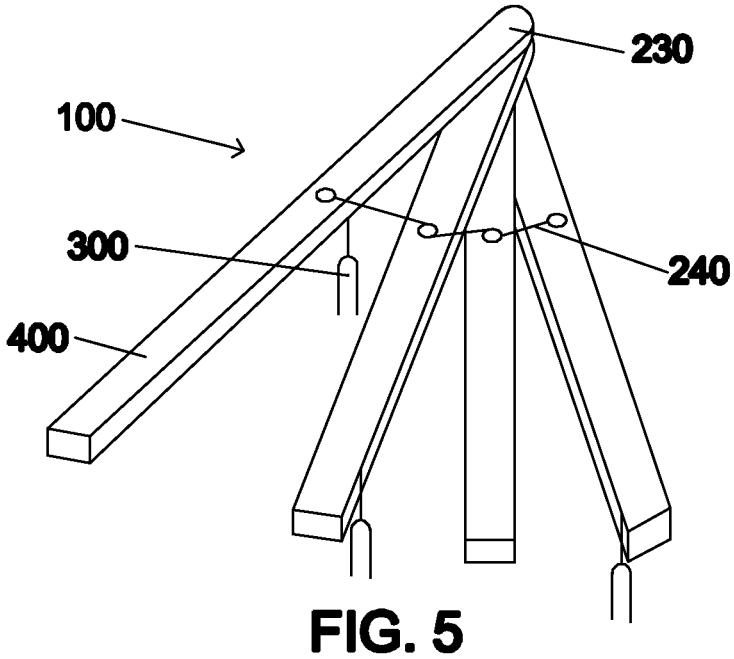
FIG. 5 is an elevated view the pleat making device according to an exemplary embodiment of the present invention.

In one aspect, the segment frame hinge 230 can engage a plurality of segment frames 400 and allows said segment frames 400 to move between a first position and a second position around a common axis. In one aspect, as shown in FIG. 5, for example, without limitation, the segment frame hinge 230 engages a plurality of segment frames 400, here rods by way of example, at one end of the rods thereby allowing the rods to rotate or fan out around the segment frame hinge 230. The fabric securing members 300 are engaged at the base of the rods in a staggered manner. The fabric 110 can be inserted into the fabric securing members 300 and the rods can be fanned out thereby creating the pleats. In this aspect, the pleat making device 100 can have a connecting member 450 that engages a plurality of segment frames 400, thereby preventing the segment frames 400 from fanning out.

Figure 6:
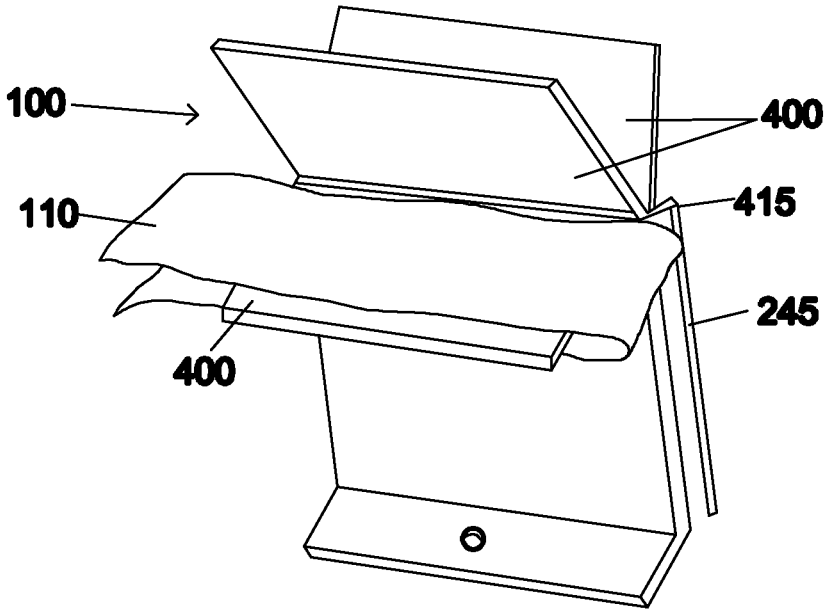
FIG. 6 is an elevated view the pleat making device according to an exemplary embodiment of the present invention.

In one aspect, as shown in FIG. 6, for example, without limitation, a plurality of segment frames 400, here plates 410 by way of example, are aligned where the segment frame hinge 230 engages the segment frames 400 together around a common axis similar to a notepad binding. While the common axis can be on any side of the segment frame 400, in this aspect, the common axis is on top 415. The first position of the segment frame 400 can be above the horizontal axis of the segment frame hinge 230 and the second position of the segment frame 400 can be below the horizontal axis of the segment frame hinge 230.

Figure 8:
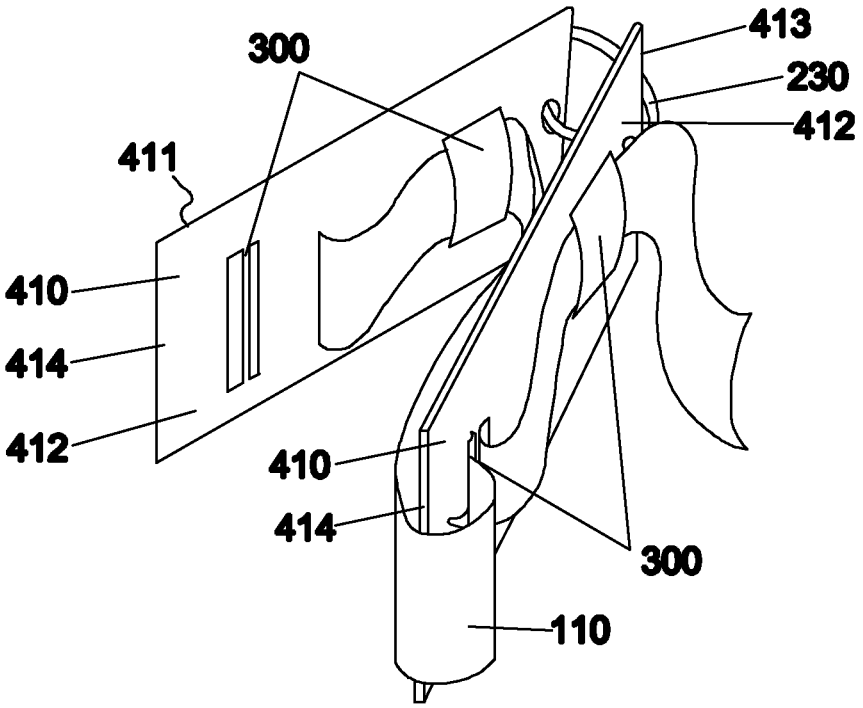
FIG. 8 is an elevated view the pleat making device according to an exemplary embodiment of the present invention.

In another aspect, as shown in FIG. 8, the segment frame hinge 230 is a loop that engages a plurality of segment frames 400 by passing through a segment frame hole 421 in each of the segment frames 400 where the loop allows a segment frame 400 to slide horizontally in relation to the other segment frames 400, thereby allowing each segment frame 400 to become staggered in relation to the other segment frames 400. The loop preferably has a slight amount of slack in the string that allows the segment frames 400 to slide horizontally. In another aspect, the loop is made of elastic that allows for a slight amount of slack in the loop. While the loop is preferably made of string, all forms are contemplated, for example, without limitation, elastic, plastic, metal, or the like. In another aspect, the segment frame hinge 230 can be a plurality of loops that engage the segment frames 400 by passing through a plurality of segment frame holes 421.

In one aspect, the fabric securing member 300 can be incorporated into the segment frame 400. When the fabric 110 is wrapped around the segment frame 400 and the segment frame 400 is moved from the above position to the below position against the back plate 245, the fabric 110 is wedged between the back plate 245 and the segment frame 400, thereby securing the fabric 110 to the frame 200. Similarly, once the fabric 110 is wrapped around the second segment frame 400, the segment frame 400 is moved from the above position to the below position, thereby wedging the fabric 110 between the first segment frame 400 and the second segment frame 400.

Figure 7:
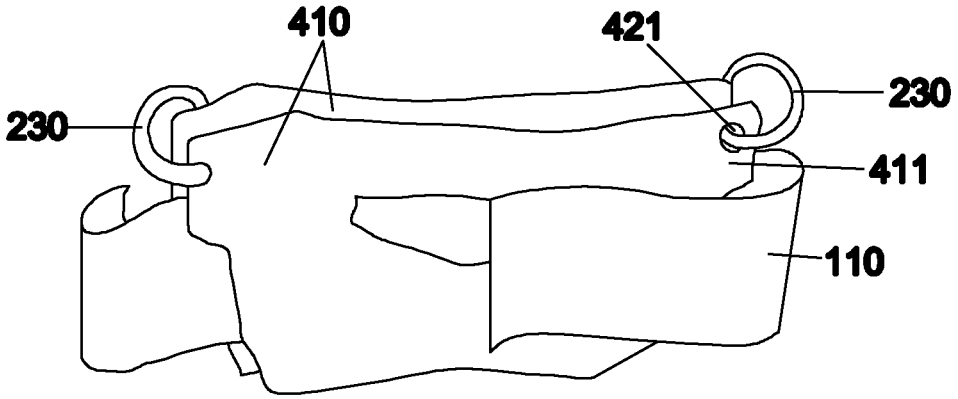
FIG. 7 is an elevated view the pleat making device according to an exemplary embodiment of the present invention.

In another aspect, as shown in FIG. 7, for example, without limitation, the plurality of segment frames 400, here plates 410, by way of example, are aligned in a manner similar to pages of a book and the segment frame hinge 230 engages the segment frames 400 together around a common axis similar to a book binding. In this aspect, the common axis is on side 413 whereby the plates 410 are moved from a first position to a second position similar to pages of a book. The first position of the plate 410 can be in the closed position and the second position of the plate 410 can be in the open position. Also in this aspect, the plates 410 can have a plurality of fabric securing members 300 that can be engaged to the front surface 411 or the rear surface 412 of the plate 410. In one aspect, at least one fabric securing member 300 can be positioned proximate to side 413, and at least one fabric securing member 300 can be positioned proximate to side 414.

As shown in FIG. 7, the fabric 110 is secured into the fabric securing member 300 engaged to front surface 411 of the first plate 410 proximate to side 414, wrapped around the side 414 of the first plate 410, secured into the fabric securing member 300 attached to the rear surface 412 of the first plate 410 proximate to side 413, secured into the fabric securing member 300 engaged to the front surface 411 of a second plate 410 proximate to side 414, wrapped around the side 414 of the second plate 410, and secured into the fabric securing member 300 attached to the rear surface 412 of the second plate 410 proximate to side 413, thereby creating pleats. This can continue until the desired number of pleats is obtained.

Figure 9:
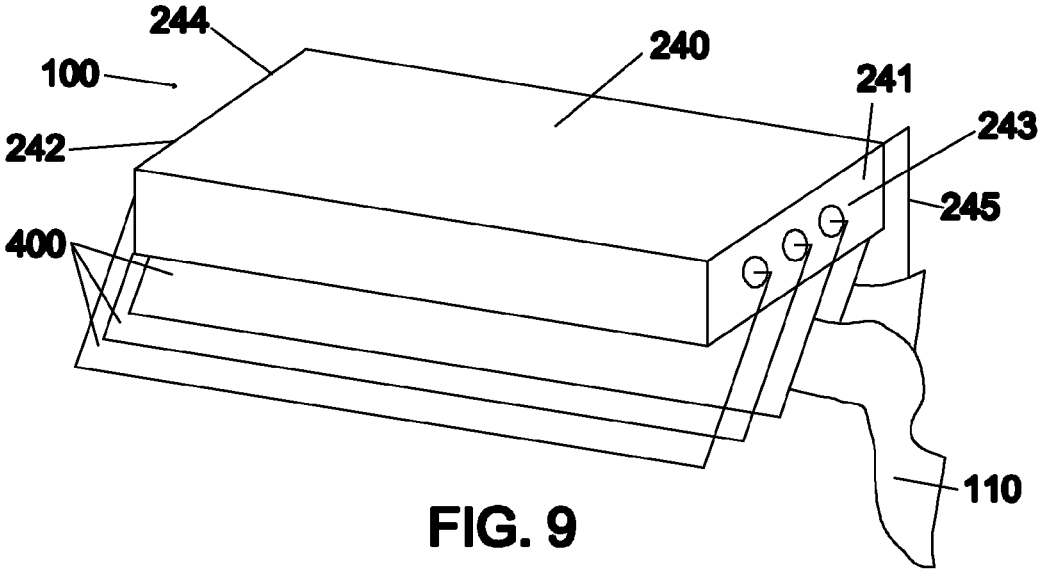
FIG. 9 is an elevated view the pleat making device according to an exemplary embodiment of the present invention.

In one aspect, the frame 200 can also have a segment frame holder 240 that engages the segment frames 400. The segment frame holder 240 can have side 241, side 242, first set of holes 243, second set of holes 244, and back plate 245. The segment frame holder 240 can engage the segment frames 400 in a variety of ways. As shown in FIG. 9, for example, without limitation, the segment frame holder 240 rotationally engages the segment frames 400 where each segment frame 400 rotates around the same side of each segment frame 400 from a front to back position. In said aspect, the segment frames 400 rotate around top 415. In said aspect, the first set of holes 243 can be provided on side 241 and the second set of holes 244 can be provides on side 242 of the segment frame holder 240 that allows a peg on the segment frames 400 to rotationally engage with the segment frame holder 240.

Also in said aspect, the fabric 110 securing means 300 can be the interaction of a segment frame 400 with another component of the frame 200 where after the fabric 110 is wrapped around the segment frame 400, the segment frame 400 is moved from the front position to the back position against a back plate 425 thereby wedging said fabric 110 between the back plate 245 and the segment frame 400. Similarly, once the fabric 110 is wrapped around the second segment frame 400, the segment frame 400 is moved from the front position to the back position, thereby wedging the fabric 110 between the first segment frame 400 and the second segment frame 400.

In one aspect, the first set of holes 243 on side 241 of the segment frame holder 240 can be horizontally offset from the second set of holes 244 on side 242, thereby making a segment frame 400 bi-stable and allowing it to remain in either the forward position or back position.

Figure 10:
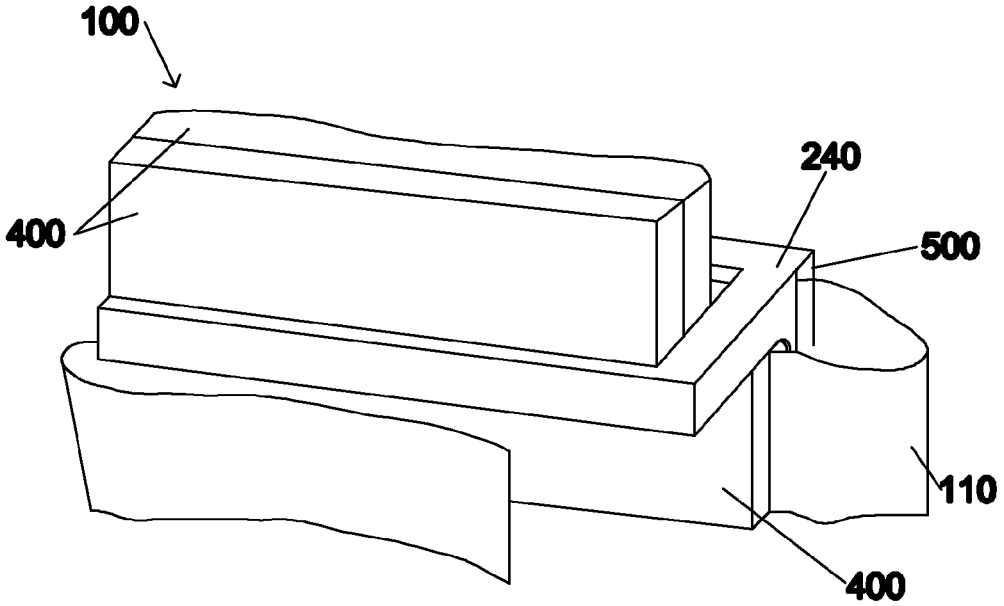
FIG. 10 is an elevated view the pleat making device according to an exemplary embodiment of the present invention.

In one aspect, the segment frame holder 240 can have a plurality of tracks where a plurality of segment frames 400 vertically travel said tracks between a first position and a second position. The first position can be above the segment frame holder 240 and the second position can be below the segment frame holder 240. As shown in FIG. 10, for example, without limitation, the segment frames 400 can start in the first position above the segment frame holder 240. The proximal segment frame 400, or the segment frame 400 closest to the back plate 245, can be the first segment frame 400 to pass through the segment frame holder 240 from the first position to the second position. The fabric 110 is wrapped around the first segment frame 400. The adjacent segment frame 400 is the second segment frame 400 to pass through the segment frame 400 from the first position to the second position. The fabric 110 is wrapped around the second segment frame 400 in a manner that creates a pleat in the fabric 110. Additional segment frames 400 pass through the segment frame holder 240 from the first to second position and the fabric 110 is wrapped around the segment frames 400 in a similar fashion. This can continue until the desired number of pleats is obtained.

Figure 11:
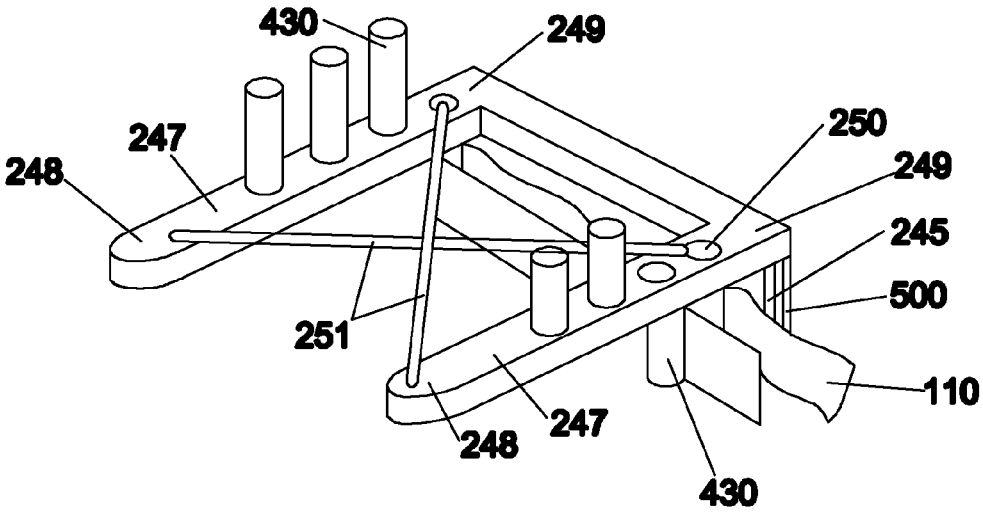
FIG. 11 is an elevated view the pleat making device according to an exemplary embodiment of the present invention.

In one aspect, as shown in FIG. 11, for example, without limitation, the segment frame holder 240 can also have at least two segment arms 247. The segment arms 247 can have a distal end 248 and a proximate end 249. The segment arms 247 engage the back plate 245 and have a plurality of holes 250 for receiving the posts 430 in a vertical direction and thereby allowing said posts 430 to traverse the segment arms 247. The segment arms 247 are positioned substantially perpendicular to the back plate 245 and substantially parallel to the other segment arm 247. One post 430 of the segment frame 400 is slidably engaged to one segment arm 247 and another post 430 of the segment frame 400 is slidably engaged to another segment arm 247. The segment frame 400 can traverse the segment arms 247 from a first position above the segment arms 247 to a second position below the segment arms 247. In one aspect, the segment frame 400 can be at least two posts 430. While the segment arm 247 can have one post 430 per segment arm 247, the preferred aspect has a plurality of posts 430 per segment arm 247.

In addition, the segment frame holder 240 can also have a segment frame support 251. The segment frame support 251 can be any means that provides support to the segment arms 247 by preventing them from collapsing toward base plate 245. In the preferred aspect, as shown in FIG. 11, for example, without limitation, the segment frame support 251 is an "X" support having two rods that run diagonally between the two segment arms 247 where one rod engages the distal end 248 of the first segment arm 247 and the proximal end 249 of the second segment arm 247, and another rod engages the distal end 248 of the second segment arm 247 and the proximal end 249 of the first segment arm 247.

Also shown in FIG. 11, for example, without limitation, the at least two posts 430 can start in the first position above the segment arms 247. The proximal posts 430, or the posts 430 closest to the base plate 245, are the first two posts 430 to traverse the segment arms 247 from the first position to the second position. The fabric 110 is wrapped around the first two posts 430. The adjacent two posts 430 are the second two posts 430 to traverse the segment arms 247 from the first position to the second position. The fabric 110 is wrapped around the second two posts 430 in a manner that creates a pleat in the fabric 110. Two additional posts 430 traverse the segment arms 247 from the first position to the second position and the fabric 110 is wrapped around the two posts 430 in a similar fashion. This can continue until the desired number of pleats are obtained.

Figure 12:
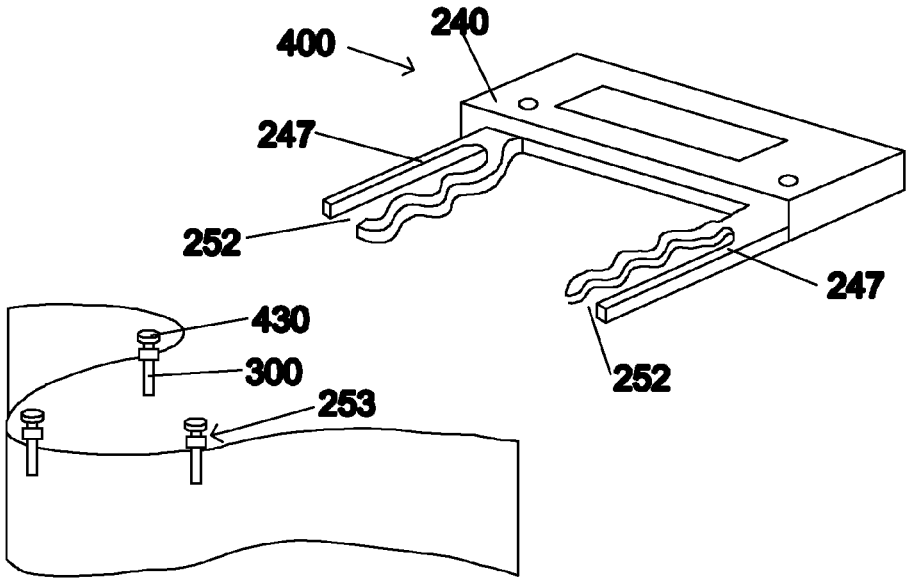
FIG. 12 is an elevated view the pleat making device according to an exemplary embodiment of the present invention.

In one aspect, the first segment arm 247*a* can have a first segment arm track 252*a* and the second segment arm 247*b* can have a second segment arm track 252*a*. The plurality of segment frames 400 can horizontally travel the first segment arm track 252*a* and the second segment arm track 252*b*. In this aspect, the segment frames 400 can be posts 430 and the fabric securing members 300 can be incorporated into the segment frames 400. In the preferred aspect, the fabric securing members 300 are clothes pins. Once the fabric securing members 300 engage the fabric 110, the posts 430 can travel the segment arm tracks 252*a*, 252*b* alternating between the first segment arm tracks 252*a* and second segment arm tracks 252*b*. As shown in FIG. 12, the side of the post 430 has two cavities 253 that allow the post to horizontally traverse segment arm track 252*a*, 252*b*. The first fabric securing member 300 is pinned on the top of the fabric 110 and the first post 430 is slid into the first segment arm track 252*a*. The second fabric securing member 300 is pinned on the top of the fabric 110 at a distance from the first fabric securing member 300 that will allow for the desired width of the first pleat. The second post 430 is slid into the second segment arm track 252*b*. The third fabric securing member 300 is pinned on the fabric 110 at a distance from the second clothes pin that will allow for the desired width of the second pleat. The third post 430 is slid into the first segment arm track 252. Additional fabric securing members 300 can be pinned to the fabric 110 and the corresponding posts 430 can be slid into the segment arm tracks 252*a*, 252*b* alternating between the first segment arm track 252*a* and second segment arm track 252*b* until the desired number of pleats are obtained.

Figure 13:
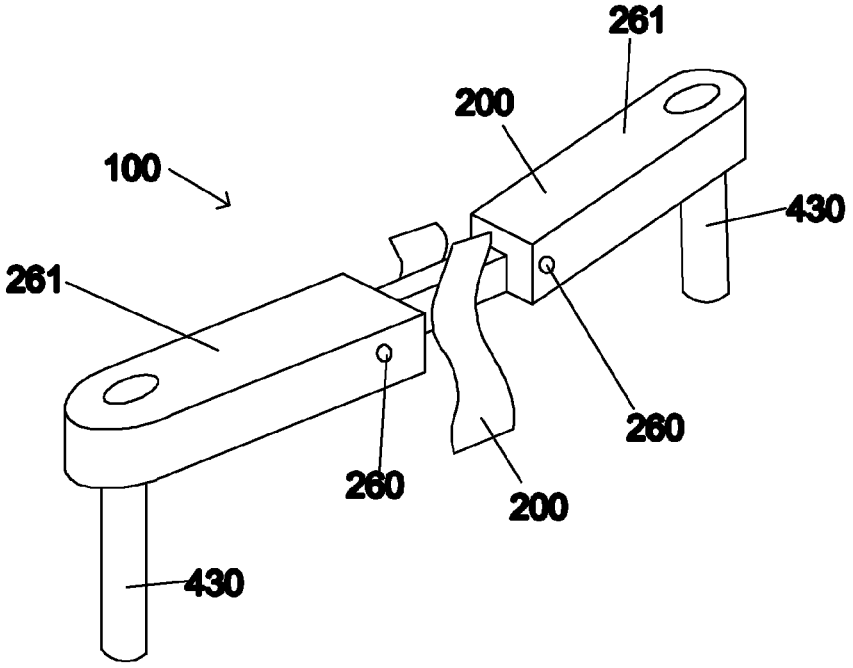
FIG. 13 is an elevated view the pleat making device according to an exemplary embodiment of the present invention.

In one aspect, as shown in FIG. 13, for example, without limitation, the frame 200 can also have a post hinge 260 that allows for the movement of at least two posts 430 between a first position and a second position. The first position can be in the downward position and the second position can be in the upward position. The post hinge 260 can be positioned at any point along the frame 200. In one aspect, the post hinge 260 is position in the horizontal interior of the frame 200 thereby allowing the frame ends 261 to rotate in an upward direction. The upward rotation of the frame ends 261 causes the posts 430 to pull out of the pleat thereby allowing the post 430 to be reused to create another pleat.

In one aspect, the device can also have a pleat gatherer 700 that prevents said pleats from unraveling. The pleat gatherer 700 can be any means that gathers pleats together thereby preventing unraveling of the pleats, for example, without limitation, a clamp, a clip, a clothes pin, a pin, an alligator clip, a magnetic clamp, or the like. The pleat gatherer 700 can be engaged with the frame 200 or free standing from the frame 200. The pleat gatherer 700 can engage the frame 200 in any manner that allows the pleat gatherer 700 to be used in relation to the pleats. In one aspect, the pleat gatherer 700 can be engaged to a connecting member where the connecting member engages the frame 200. The pleat gatherer can be positioned in a horizontal or vertical manner. The connecting member can be any means that allows for the connecting member to engage the frame 200, for example, without limitation, a cord, string, rope, flexible plastic, rigid plastic, metal, wood, or the like. The pleat gatherer 700 can be used to add one pleat to a collection of pleats or can gatherer a plurality of pleats at one time.

In one aspect, the posts 430 are wrapped with fabric 110 in a manner that creates a pleat with the frame ends 261 in the downward position. The frame ends 261 rotate in an upward direction causing the posts 430 to pull out of the pleat. The pleat is gathered by the pleat gatherer 700. This process can continue until a desired number of pleats are obtained.

Figure 14:
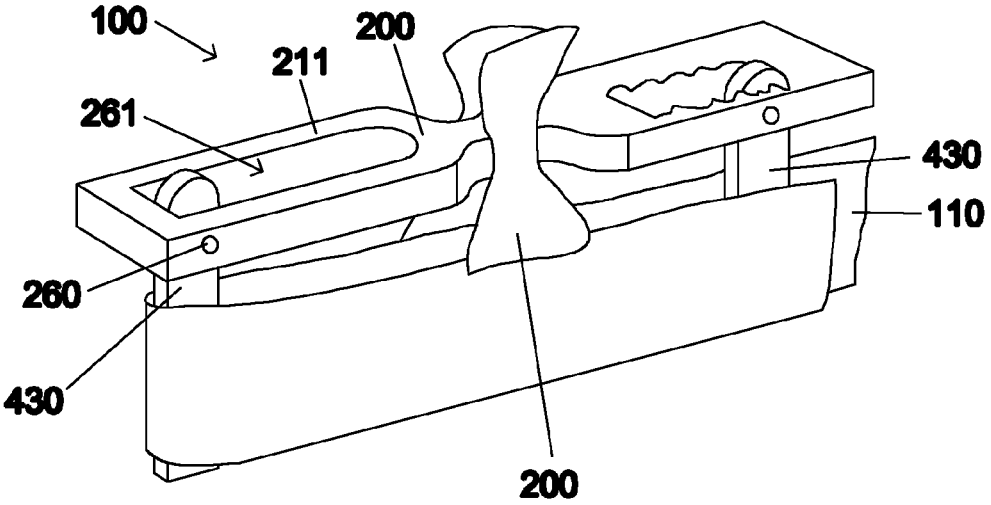
FIG. 14 is an elevated view the pleat making device according to an exemplary embodiment of the present invention.

In one aspect, the post hinge 260 allows for the posts 430 to rotationally engage the frame 200 between a first and second position. As shown in FIG. 14, for example, without limitation, the frame 200 can have a cavity 261 that allows a portion of the post 430 to penetrate said cavity 261. A peg passes through the frame 200 and the post 430 thereby rotationally engages the post 430 to the frame 200. The post 430 can protrude above top 211 of the frame 200 thereby allowing the post 430 to rotate out of the pleat. Once the post 430 rotates out of the pleat, the post 430 can be reused to create another pleat. In one aspect, the posts 430 are wrapped with fabric 110 in a manner that creates a pleat with the posts 420 in the downward position. The posts 430 rotate in an upward direction causing the posts 430 to pull out of the pleat. The pleat is gathered by the pleat gatherer 700. This process can continue until a desired number of pleats is obtained.

Figure 15:
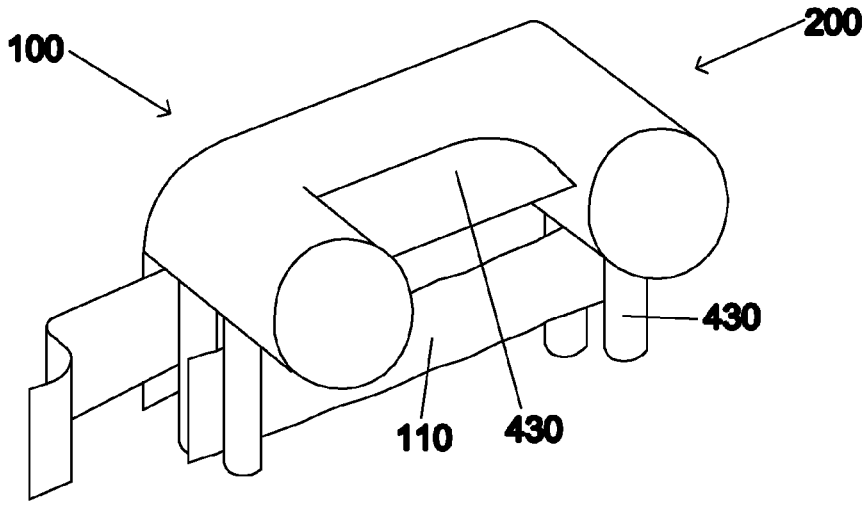
FIG. 15 is an elevated view the pleat making device according to an exemplary embodiment of the present invention.

In one aspect, the post hinge 260 allows for the posts 430 to rotationally engage the frame 200 between a first and second position where said first position is a stored position and said second position is a pleat making position. As shown in FIG. 15, for example, without limitation, said frame 200 has a track that allows for the post to move between the first and second position. The post 430 can travel from the first position through the track to the second position.

Figure 16:
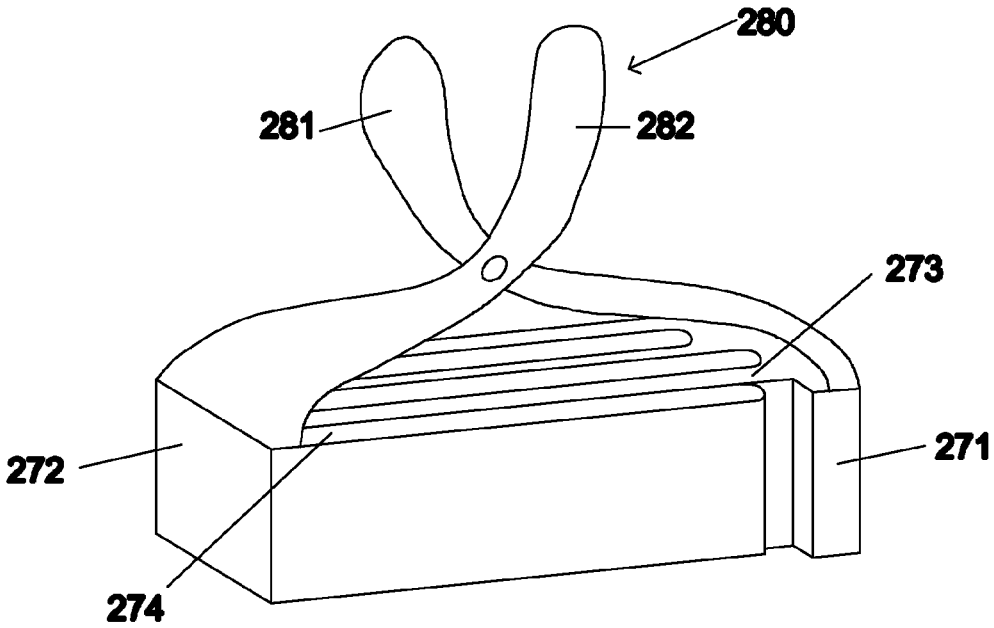
FIG. 16 is an elevated view the pleat making device according to an exemplary embodiment of the present invention.

In one aspect, the frame 200 can have a first frame member 271, a second frame member 272, a plurality of first posts 273, a plurality of second posts 274, and a handle 280. The handle 280 can have a first handle member 281 and a second handle member 282 where the first handle member 281 can engage the first frame member 271 and the second handle member 282 can engage the second frame member 272. The first posts 273 can engage the first frame member 271 and the second posts 274 can engage the second frame member 272. As shown in FIG. 16, for example, without limitation, fabric 110 is placed between the first posts 273 and the second posts 274. The first handle member 281 and the second handle member 282 are compressed together thereby causing the vertical plane created by the first posts 273 to cross the vertical plane created by the second posts 274 and creating a multitude of pleats in the fabric 110.

In this aspect, the fabric securing member 300 can be incorporated into said first and second frame members 272 where the tension of the fabric 110, when the fabric 110 is wrapped around a post after the vertical plane of the first posts 273 crosses the vertical plane of the second posts 274, secures the fabric 110 to the posts.

Figure 17:
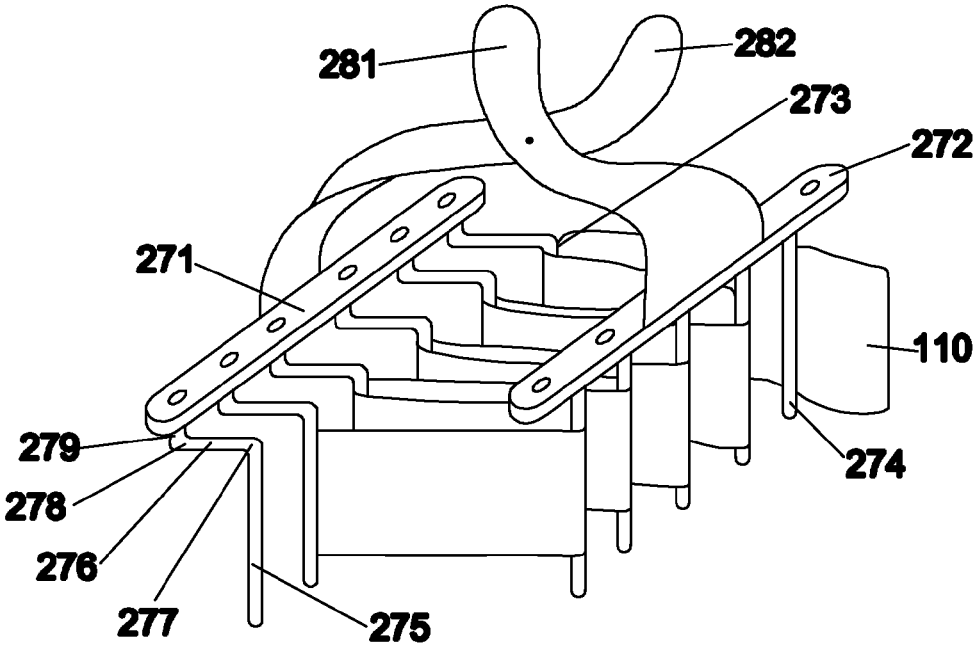
FIG. 17 is an elevated view the pleat making device according to an exemplary embodiment of the present invention.

In one aspect, the first posts 273 can have a base vertical member 275, a horizontal member 276 having a first end 277 and a second end 278, and a top vertical member 279. The base vertical member 275 can engage the first end 277 of the horizontal member 276 thereby creating a substantially right angle, and the top vertical member 279 can engage the second end 278 of the horizontal member 276 thereby creating a second substantially right angle. The horizontal member 276 allows the base vertical member 275 to engage said first frame member 271 while allowing the vertical plane created by the second posts 274 to cross the vertical plane created by the base vertical member 275 of the first posts 273. As shown in FIG. 17, for example, without limitation, fabric 110 is placed between the first posts 273 and the second posts 274. The first handle member 281 and the second handle member 282 are compressed together thereby causing the vertical plane created by the second posts 274 to cross the vertical plane created by the base vertical member 275 of the first posts 273 and creating a multitude of pleats in the fabric 110.

In one aspect, the pleat making device 100 can have a mounting member 500 that allows the device to be mounted to clothing or a clothing accessory. The mounting member 500 can engage the frame 200 at any location of the frame 200. In the preferred aspect, the pleat making device 100 is mounted to a waist band. The mounting member 500 can be any means for attaching the pleat making device 100 to a piece of clothing, for example, without limitation, a clip, or the like. In another aspect, the mounting member 500 can be a segment frame 400.

In one aspect, the pleat making device 100 can also have a means for collapsing the device 600 that allows the device to be folded in a compact manner. The means for collapsing the device 600 can be any means that allows the device to transition from a first position to a second position. The first position can be an open position that allows for the creation of pleats in fabric 110 and the second position can be a closed or collapsed position that allows the pleat making device 100 to be more easily stored or transported. For example, without limitation, the frame supports 251 of the pleat making device 100 in FIG. 11 can releasably engage the segment arms 247 at the distal end 248 and rotationally engage the proximal end 249 of the segment arms 247 by way of a hinge thereby allowing the frame supports 251 to rotate around the vertical axis of the hinge. The segment arms 247 can rotationally engage the back plate 245 by way of a hinge thereby allowing the segment arms 247 to rotate around the vertical axis of the hinge. With the posts 430 in the downward position, frame supports 251 can disengage from the distal end 248 of the segment arms 247 and rotate toward the back plate 245 thereby stopping at a position adjacent and parallel to the back plate 245. The segment arms 247 can rotate towards the back plate 245 thereby stopping at a position adjacent and parallel to the back plate 245.

Figure 18A:
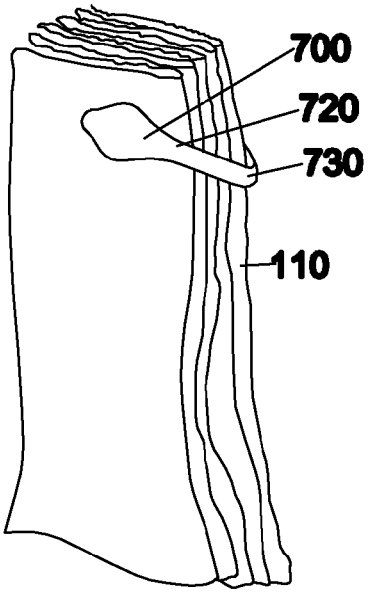
FIG. 18*a* is a side view of the pleat gatherer according to an exemplary embodiment of the present invention.
Figure 18B:
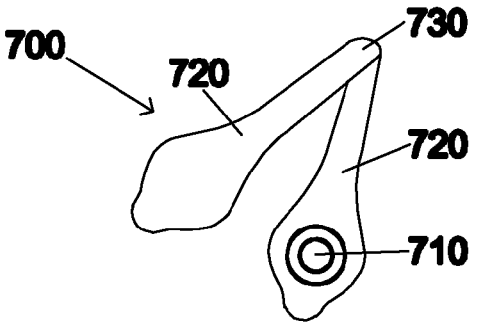
FIG. 18*b* is a side view of the pleat gatherer according to an exemplary embodiment of the present invention.

By way of example, as shown in FIG. 18*a*, once the pleats are created using the pleat making device 100, the pleat gatherer 700 secures the pleated fabric 110 thereby preventing the pleated fabric 110 from unraveling when the pleated fabric 110 is removed from the pleat making device 100. While the pleat gatherer 700 is preferably a magnetic clip, all forms are contemplated, for example, without limitation, a clothes pin, an alligator clip, a clamp, or the like.

Where the pleat gatherer 700 is a magnetic clip, the pleat gatherer 700, as shown in FIG. 18*b*, has at least two magnets 710, at least two frame members 720, and a pleat gatherer hinge 730. The magnets 710 engage the frame members 720 in a manner that allows the magnets to secure fabric 110 in a preferred position. While the magnets 710 preferably engage the frame members 720 at the end of the frame members 720 opposite the pleat gatherer hinge 730, the magnets 710 can engage the frame members 720 at any position along the frame members 720. The magnets 710 are positioned in a manner where one magnetic pole 711 of one magnet 710 faces the opposite magnetic pole 711 of the other magnet 710 thereby causing the magnets 710 to be attracted to each other. The magnets 710 can decrease the damage caused to the fabric 110 by allowing the fabric 110 to be gathered without the use of a safety pin that can often damage the fabric 110 by pulling its thread. The magnets 710 allow for a decrease in the number of injuries to the operator by avoiding fingers being pricked from pushing a pin through multiple layers of fabric 110.

The pleat gatherer hinge 730 can engage a first frame member 720 and can engage a second frame member 720, thereby allowing said frame members 720 to move between a first position and a second position. The pleat gatherer hinge 730 can be any connecting device that allows for the rotation of two frame members 720 around the axis of the pleat gatherer hinge 730, for example, without limitation, a hinge, a living hinge, a swivel hinge, a spiral binding, a glued binding, a spring hinge, or the like. In one aspect, the pleat gatherer hinge 730 allows for the rotation of two frame members 720 in opposite rotations, where one frame member 720 rotates in a plane that is substantially parallel to the plane of the other frame member 720.

Figure 18C:
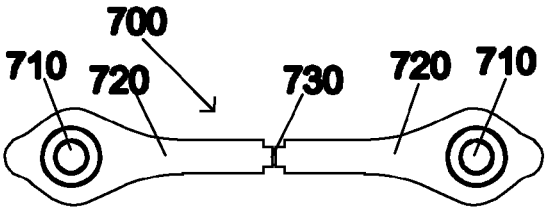
FIG. 18*c* is a top plan view of the pleat gatherer according to an exemplary embodiment of the present invention.

The pleated fabric 110 can be received by the pleat gatherer 700 between the two magnets 710 and the attraction of the two magnets 710 clamps the pleated fabric 110, thereby preventing the pleated fabric 110 from unraveling. The pleat gatherer 700 can be removed from the pleated fabric 110 by prying the magnets 710 away from each other, resulting in a position shown in FIG. 18*c*, or sliding the magnets 710 in opposite directions where the plane of the rotation of one magnet 710 is substantially parallel to the plane of the rotation of the other magnet 710, as shown in FIG. 18*b*. In one aspect, the magnets 710 allow the pleat gatherer 700 to be removed with one hand, thereby allowing the operator to tend to the pleat making device 100 or the pleated fabric 110 while removing the pleat gatherer 700 from the pleated fabric 110.

In one aspect, the pleat gatherer 700 can be used in a standalone manner to create pleats without the use of the pleat making device 100. In such an embodiment, pleats are created in the fabric 100 without using a pleat making device. Once a pleat is created, the pleat gatherer 700 clamps the pleated fabric 110 together thereby securing the pleated fabric 110 and preventing it from unraveling. The pleated fabric 110 is tucked or placed at a desired location and the pleat gatherer 700 is removed from the pleated fabric 110.

The pleat making device 100 is used by mounting the pleat making device 100 to a piece of clothing worn by the operator, securing the fabric 110 to a front surface of a first segment frame 400 by way of a fabric securing member 300, wrapping the fabric 110 around a first segment frame 400, securing the fabric 110 to a rear surface of a first segment frame 400 by way of a fabric securing member 300, rotating the first segment frame 400 away from a plurality of segment frames 400, securing the fabric 110 to different a segment frame 400 by way of a fabric securing member 300, wrapping the fabric 110 around the different segment frame 400, securing the fabric 110 to a rear surface of a different segment frame 400 by way of a fabric securing member 300, rotating the different segment frame 400 away from the plurality of segment frames 400, repeating the above mentioned steps until the preferred number of segment frames 400 are wrapped with fabric 110, gathering the pleated fabric 110 together utilizing a pleat gatherer 700, removing the pleated fabric 110 from the pleat making device 100 while maintaining the pleated form of the fabric 110, removing the pleat making device 100 from the clothing, tucking or placing the pleated fabric 110 at a desired location, and removing the pleat gatherer upon the removal of the garment.

The pleat making device 100 and all its components, for example, without limitation, the frame 200, fabric securing member 300, segment frame 400, plate 410, post 430, segment frame hinge 230, track, width adjusting member 440, post hinge 260, segment frame holder 240, first frame member 271, second frame member 272, handle 280, first handle member 281, second handle member 282, base vertical member 275, horizontal member 276, top vertical member 279, back plate 245, segment arm 247, segment frame support 251, pleat gatherer 700, mounting member 500, means for collapsing the device 600, can be made of any rigid or flexible material, for example without limitation, plastic, wood, metal, wire bail, or the like. In the preferred aspect, the pleat making device is made of rigid plastic.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention. Modifications and variations of the present invention are possible in light of the above teachings. It is therefore to be understood that the invention may be practiced otherwise than as specifically described herein.

What is claimed is:

1. A pleat making device for making pleats of fabric comprising:

a frame having a segment frame, a fabric securing member incorporated into the segment frame for securing the fabric to the segment frame and mounting the device to the clothing of a user, and a segment frame hinge that rotationally engages a first segment frame and rotationally engages a second segment frame allowing the first segment frame and second segment frame to rotate between a first position and a second position.

2. The device of claim 1 wherein said frame further comprises a segment frame hinge wherein said segment frame hinge engages a plurality of segment frames and allows said segment frames to move between a first position and a second position around a common axis.

3. The device of claim 2 wherein said segment frame hinge allows said segment frames to move horizontally thereby staggering each segment frame in relation to the other segment frames.

4. The device of claim 1 wherein said frame further comprises a segment frame holder wherein said segment frame holder engages said segment frames and allows said segment frames to rotate in a manner wherein each segment frame rotates around a side common to each segment frame.

5. The device of claim 1 wherein said frame further comprises a segment frame holder comprising a plurality of tracks, wherein a plurality of segment frames traverse said plurality of tracks.

6. The device of claim 1 wherein said segment frame is at least two posts.

7. The device of claim 6 wherein said frame further comprises a post hinge that allows for the movement of said at least two posts between a first position and a second position.

8. The device of claim 1 wherein said segment frame holder allows said segment frames in said first position to traverse through said segment frame holder to said second position.

9. The device of claim 1 wherein said segment frame comprises a width adjusting member.

10. The device of claim 1 wherein said segment frame comprises a feathered side that allows for the separation of the segment frames.

11. The device of claim 1 wherein said frame comprises:

a first frame member, a second frame member, a plurality of first posts, a plurality of second posts, and a handle comprising a first handle member and a second handle member, wherein said first posts engage said first frame member, said second posts engage said second frame member, said first handle member engages said first frame member, said second handle member engages said second frame member, and said fabric securing member is incorporated into said first frame member and said second frame member.

12. The device of claim 11 wherein said first posts comprise:

a bottom vertical member, a horizontal member, comprising a first end and a second end, and a top vertical member, wherein said bottom vertical member engages said first end of said horizontal member thereby creating a first substantially right angle, and said top vertical member engages said second end of said horizontal member thereby creating a second substantially right angle.

13. The device of claim 1 further comprising a pleat gatherer that prevents said pleats from unraveling.

14. A method for making a pleat using a pleat making device, comprising the steps of:

(a) securing the fabric to a front surface of a first segment frame by way of a fabric securing member, (b) wrapping the fabric around the first segment frame, (c) securing the fabric to a rear surface of the first segment frame by way of a fabric securing member, (d) rotating the first segment frame away from a plurality of segment frames, (e) securing the fabric to a different segment frame by way of a fabric securing member, (f) wrapping the fabric around the different segment frame, (g) securing the fabric to a rear surface of the different segment frame by way of a fabric securing member, (h) rotating the different segment frame away from the plurality of segment frames, (i) repeating steps (e)-(h) until a preferred number of segment frames are wrapped with fabric, (j) gathering the pleats together utilizing a pleat gatherer, and (k) removing the fabric from the pleat making device while maintaining the pleated form of the fabric.

15. The device of claim 1 wherein the fabric securing member comprises a first magnet and a second magnet, allowing for the fabric to be received between the first magnet and the second magnet and allowing for the fabric to be secured to the segment frame upon the first magnet magnetically interacting with the second magnet.

16. The device of claim 1 wherein the fabric securing member is a clip for slideably receiving the fabric allowing for the fabric to be secured to the segment frame.

17. The device of claim 1 wherein the segment frame is a plate, where the fabric is secured to one end of the plate by way of a securing member positioned at one end of the plate and the fabric is secured to another end of the plate by allowing for the fabric to be wrapped from one side of the plate around the other end of the plate to an opposite side of the plate.

18. The device of claim 1 wherein the segment frame is a plate, where the length of the plate is substantially similar to the length of the pleat created by the device.

19. The device of claim 1 wherein the length of the pleat is substantially similar to the distance between the securing member at one end of the plate and another end of the plate.

20. The device of claim 1 wherein the length of the pleat is substantially similar to the distance between a first securing member positioned at one end of the plate and a second securing member positioned at another end of the plate.

21. A pleat making device for making pleats of fabric comprising:

a frame having a segment frame, a fabric securing member incorporated into the segment frame for securing the fabric to the segment frame, a segment frame hinge that rotationally engages a first segment frame and rotationally engages a second segment frame allowing the first segment frame and second segment frame to rotate between a first position and a second position, and a mounting member allowing for the device to be mounted to the clothing of a user, the mounting member having a cantilevered member and a mounting component, whereby one end of the cantilevered member engages the segment frame and the other end of the cantilevered member engages the mounting component, the mounting component engaging the cantilevered member in a substantially parallel position in relation to the segment frame, whereby the position of the segment frame, cantilevered member, and mounting member create a mounting gap for receiving a clothing waistband.

* * * * *